US007464642B2

(12) United States Patent
Schaede

(10) Patent No.: US 7,464,642 B2
(45) Date of Patent: Dec. 16, 2008

(54) BLANKET CYLINDER FOR AN INTAGLIO PRINTING MACHINE

(75) Inventor: Johannes Georg Schaede, Würzburg (DE)

(73) Assignee: KBA-Giori S.A., Lausanne (CH)

( * ) Notice: Subject to any disclaimer, the term of this patent is extended or adjusted under 35 U.S.C. 154(b) by 218 days.

(21) Appl. No.: 10/543,462

(22) PCT Filed: Feb. 3, 2004

(86) PCT No.: PCT/IB2004/000282

§ 371 (c)(1),
(2), (4) Date: Jun. 29, 2006

(87) PCT Pub. No.: WO2004/069539

PCT Pub. Date: Aug. 19, 2004

(65) Prior Publication Data

US 2006/0243146 A1 Nov. 2, 2006

(30) Foreign Application Priority Data

Feb. 4, 2003 (EP) ..... 03002187

(51) Int. Cl.

| | |
|---|---|
| ***B41F 9/02*** | (2006.01) |
| ***B41F 13/10*** | (2006.01) |
| ***B41F 27/06*** | (2006.01) |
| ***B41M 1/10*** | (2006.01) |
| ***B41C 3/08*** | (2006.01) |
| ***B41N 6/00*** | (2006.01) |

(52) U.S. Cl. ..... 101/152; 101/170; 101/376; 101/401.1

(58) Field of Classification Search ..... 101/401.1, 101/376, 375, 368, 150, 151, 152, 170

See application file for complete search history.

(56) References Cited

U.S. PATENT DOCUMENTS

| | | | | |
|---|---|---|---|---|
| 2,099,024 | A | 11/1937 | Lewis | |
| 4,479,432 | A | 10/1984 | Masaki et al. | |
| 4,516,496 | A * | 5/1985 | Giori | 101/152 |
| 5,062,359 | A | 11/1991 | Giori | |
| 5,899,145 | A | 5/1999 | Schaede | |
| 5,908,505 | A * | 6/1999 | Bargenquest et al. | 118/211 |
| 6,368,436 | B1 * | 4/2002 | Canet et al. | 156/73.1 |
| 6,516,722 | B2 * | 2/2003 | Yamasaki | 101/467 |
| 6,691,614 | B2 * | 2/2004 | Bell et al. | 101/376 |
| 6,997,108 | B2 * | 2/2006 | Tabuchi et al. | 101/217 |

FOREIGN PATENT DOCUMENTS

| | | |
|---|---|---|
| DE | 644 341 C | 4/1937 |
| EP | 1 164 011 A2 | 12/2001 |
| GB | 762423 A | 11/1956 |
| JP | 2000-255178 | 9/2000 |

* cited by examiner

*Primary Examiner*—Anthony H Nguyen
*Assistant Examiner*—Leo T Hinze
(74) *Attorney, Agent, or Firm*—Crompton, Seager & Tufte, LLC

(57) ABSTRACT

The blanket cylinder for an intaglio printing machine comprising a plate cylinder carrying printing plates with engravings corresponding to a specific intaglio structure to be printed on a substrate, and cooperating with an impression cylinder, the blanket cylinder having at least one blanket on which the ink in the different colors is deposited by selector cylinders, each selector cylinder having reliefs with contours corresponding to the area of the intaglio structure to be inked with said color, the at least one blanket being made of several successive layers each with different properties.

12 Claims, 4 Drawing Sheets

BLANKET CYLINDER FOR AN INTAGLIO PRINTING MACHINE

The present invention concerns a blanket cylinder for an intaglio printing machine comprising at least a plate cylinder carrying printing plates with engravings corresponding to a specific intaglio structure to be printed on a substrate, and cooperating with an impression cylinder carrying a substrate to be printed, the blanket cylinder having at least one blanket on which the ink in the different colours is deposited by selector cylinders, each selector cylinder receiving ink of a given colour and having reliefs with contours corresponding to the area of the intaglio structure to be inked with said given colour.

The present invention also concerns an intaglio printing machine with a blanket cylinder.

BACKGROUND OF THE INVENTION

Intaglio printing machine are known in the prior art, especially for the printing of securities such as bank-notes and other similar objects. For example, U.S. Pat. No. 5,062,359, the content of which is enclosed by reference in the present application, discloses a sheet-fed or web-fed intaglio printing machine. This machine comprises a plate cylinder with several printing plates, an impression cylinder, a wiping device and an inking system with a collector inking cylinder, having an elastic surface, interacting with the printing plates, with selective inking cylinders having reliefs corresponding to the coloured zones to be printed in different colours and in contact with the periphery of the collector inking cylinder, and of an inking device associated with each selective colour inking cylinder.

Another machine is disclosed for example in U.S. Pat. No. 4,516,496, the content of which is enclosed by reference in the present application. This patent also discloses an intaglio printing machine similar to the one of U.S. Pat. No. 5,062,359 mentioned above. As shown in this patent, the inking system comprises a plurality of selector cylinders which are used for transferring the ink in a given colour from the inking units onto the collector cylinder, which in turn inks the engravings of the plates. Each selector cylinder has a hard surface, for example surfaces lined with hardened rubber, plastic or the like, or metal, each selector cylinder comprising relief areas having contours corresponding exactly to the contours of the surface to be printed with the corresponding colour.

Another example of an intaglio printing machine is disclosed in U.S. Pat. No. 5,899,145, the content of which is enclosed by reference in the present application.

A problem which is present in this field resides in the fact that the inking of the intaglio structure, in particular of the plates is not precise, therefore ink is transferred on a larger area than the effective intaglio structure, this ink being later wiped away by the wiping system. Accordingly, a high quantity of ink is lost because it is deposited outside the places effectively corresponding to engravings of the plates, and is then wiped away without being used for inking the plates.

Another problem one is faced with in this printing technique is the fact that, due to the high pressure necessary for the printing operation, the plates undergo an elongation deformation over their lifetime which is then prejudicial to the perfect register between the blankets of collector cylinder and the plates with the engravings. For this reason, ink is also deposited outside the engravings and is lost by the wiping operation.

In order to avoid this loss of unused ink, one thus tries to increase the precision of depositing the ink in the engravings of the plates.

SUMMARY OF THE INVENTION

It is therefore an aim of the present invention to improve the known machines and methods.

Another aim of the present invention is to reduce the quantity of ink necessary for the printing without diminishing quality of the printing.

A further aim of the present invention is to improve preciseness of the inking of the plate cylinder by the collector or blanket cylinder.

These aims are attained by reproduction of the intaglio structure to be inked on the blankets of the blanket cylinder and the use of specific materials to form the blankets.

According to particular embodiments of the invention one may use specific structures of the blankets on the collector cylinder, said structures being activated to obtain finally a very precise inking image on the plate(s).

To fulfil these aims, the invention is defined by the subject-matter of the claims.

According to a first embodiment one uses the ink separating process of lipophilic and hydrophilic structures and one then engraves this structure on the blanket, which corresponds exactly to a metal plate. The blanket is lipophilic and covered with a lipophobic/hydrophilic engravable surface, hence achieving a very precise inking of the plate. Of course, the blanket has to be redone as soon as the elongation of the metal plate creates uninked fine lines.

In a second embodiment one use the ink separating process of lipophilic and hydrophilic structures and engrave this structure on the blanket, which corresponds exactly to the metal plate. The blanket is lipophobic/hydrophilic and covered with a lipophilic engravable surface, hence achieving a very precise inking of the plate. Of course, the blanket has to be redone as soon as the elongation of the metal plate creates uninked fine lines.

In a third embodiment, one uses the ink separating process of typography and one engraves the desired structure on the blanket, which corresponds exactly to the metal plate. The blanket is covered with a lipophilic engravable surface, thus achieving a very precise inking. The blanket has to be redone as soon as the elongation of the metal plate creates uninked fine lines.

In order to form the several layers of lipophilic and/or hydrophilic materials, one may use several processes known in the art. A first process is a varnishing process in which the layers are successively added on a base layer. Another process that can be used is a laminating process. A further known process is a sol-gel process, as known under the tradename ORMOCER®e of the Fraunhofer Institut Silicatforschung (see for example the web pages published on the internet at the address www.isc.fhg.de). With the disclosed process, it is possible to build the layers of lipophilic and/or hydrophilic materials according to the invention.

BRIEF DESCRIPTION OF THE DRAWINGS

The different embodiments of the invention are now described with reference to the drawings, which show in FIG. 1 the principle of an intaglio printing machine according to the invention.

DETAILED DESCRIPTION OF THE EMBODIMENTS

Figure 1:
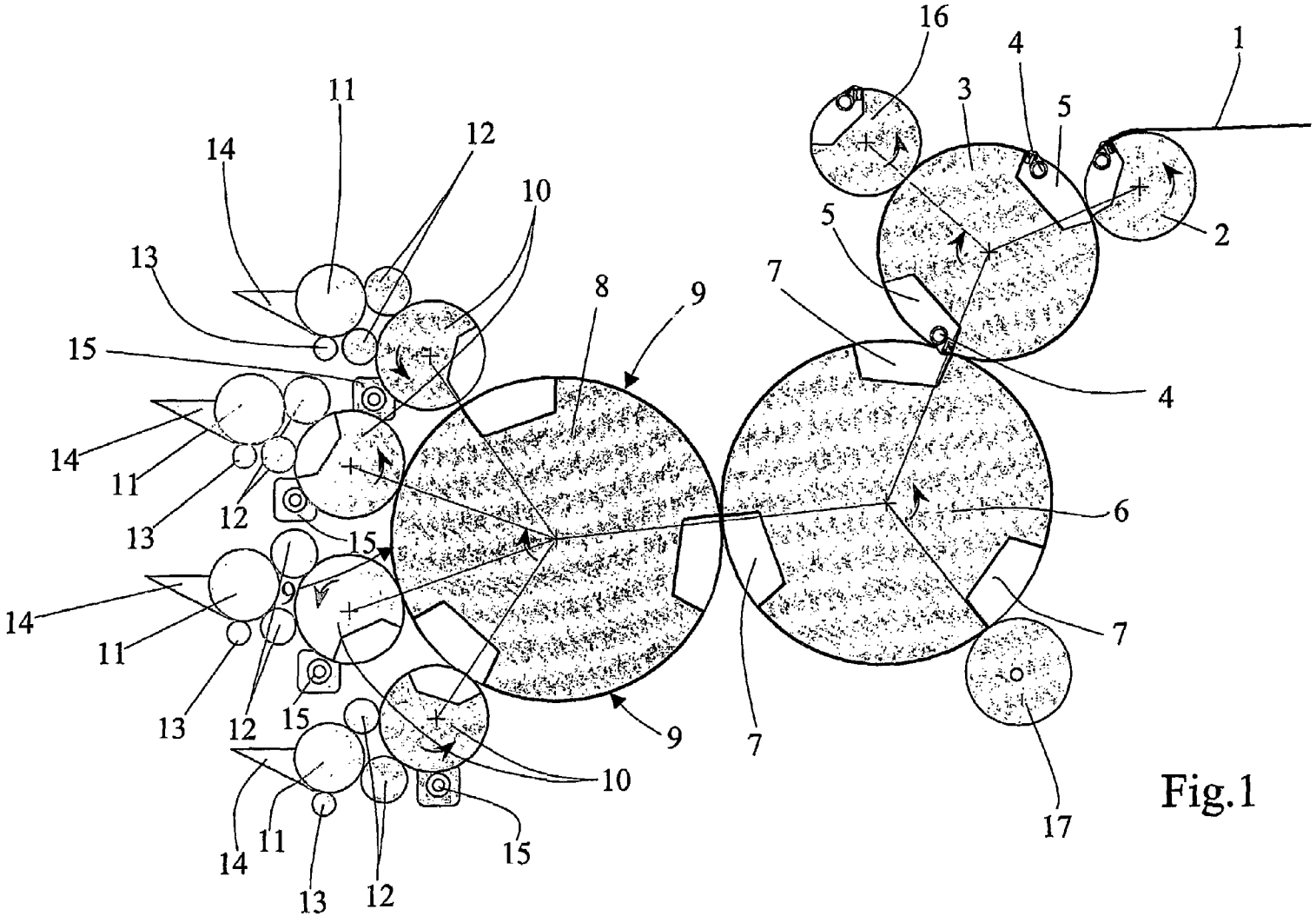

The principle of functioning of an intaglio sheet-web or web-fed printing machine is described first with reference to FIG. 1, with the different cylinders rotating in the direction shown by the arrows. The following description of the printing is given for a sheet-fed printing machine, however the same principles apply also to a web-fed printing machine. In the printing machine, the sheets 1 arrive from a feeding system (not shown) and are transferred by a transfer cylinder 2 onto an impression cylinder 3. The sheets are held on this impression cylinder 3 by grippers 4 for the impression process, said grippers being placed in cylinder pits 5. In the example shown, the impression cylinder 3 has two segments each supporting one sheet to be printed. The impression cylinder 3 cooperates with a plate cylinder 6, both cylinder 3 and 6 forming a printing nip in which the sheet receives the intaglio printing. The plate cylinder 6 carries three plates in the example of figure held by gripping systems (not shown) placed into plate cylinder pits 7. The plates, as is known in the art of printing, carry engravings corresponding to the design to be printed, and the engravings of the plates further receive the ink, which is being deposited on the successive sheets.

Next to the plate cylinder 6, there is the blanket cylinder 8, also called collector cylinder, which is used to ink the plates of the plate cylinder 6. As is schematically represented in FIG. 1, the blanket cylinder 8 carries three blankets 9. The blanket cylinder 8 has a smooth surface forming the blankets 9 and receiving ink from selector cylinders 10 distributed along the periphery of the blanket cylinder 8. Each selector cylinder 10 is inked in a given colour by an inking device. The selector cylinders 10 have a surface which is harder than the surface of the blanket cylinder 8 and their surface is divided into sections with reliefs areas having contours corresponding exactly to the contours of the engravings of the plates which are destined to receive the ink of each respective selector cylinder 10.

As is common in the art, each selector cylinder 10 is associated with an inking device comprising at least a duct roller 11, ink transfer rollers 12, an oscillator roller 13, an inker 14 containing the ink of a given colour and a drive 15 for driving the selector cylinders 10.

The ink contained in the inker 14 is transferred from the duct roller 11 to the selector cylinder 10 through ink transfer rollers 12 and then from the selector cylinder 10 onto the plate cylinder 6. The excess of ink on the plate cylinder 6 is further wiped away by wiping cylinder 17.

Once the sheets 1 have passed the printing nip and received the ink, they are taken away from the impression cylinder, for example by a delivery cylinder 16 for further treatment.

Figure 2B:
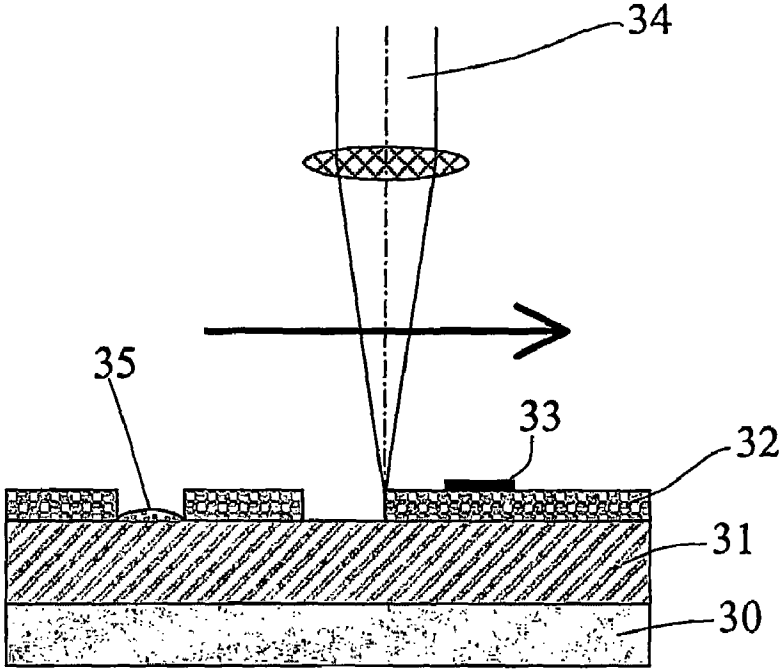
FIGS. 2A and 2B a schematic view of the layers forming the blankets of the blanket cylinder according to a first embodiment.
Figure 2A:
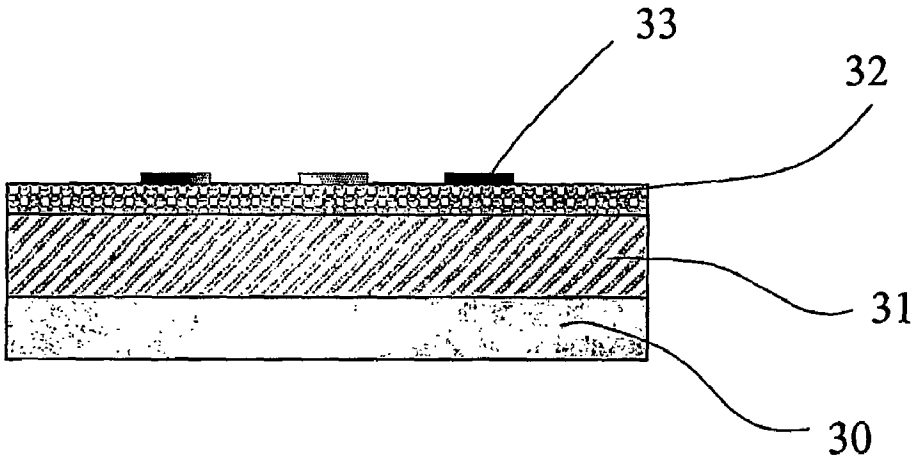

In FIG. 2A, the layers forming the blankets 9 of the blanket cylinder 8 are described in detail. The blanket cylinder 8 has a base layer 30 on which a lipophilic layer 31 is deposited. Further, over the lipophilic layer 31, an engravable lipophobic layer 32 is deposited. Finally, a structure 33 which corresponds exactly to the shape of the engravings of the plates to be inked is created over the lipophobic layer 32 in order to receive the ink from the selector cylinders 10.

The structure 33 is, for example, created in the following manner. The inking cylinder is inked completely with a selector cylinder and the ink is then transferred to the plate. Then the plate is wiped, for example by wiping cylinder 17 (FIG. 1), to remove the ink excess of the plate. The inked image of each plate of the plate cylinder 6 is then transferred to the collector cylinder 8 by rotation of the cylinders 6 and 8 with no substrate, i.e. paper, between them passing the printing nip thus forming the structure 33 shown in FIG. 2A and 2B, which corresponds exactly to the engravings to be inked on the plates of the plate cylinder 6, in perfect register.

Once the different layers have been deposited on the basic layer of the blanket cylinder and the structure 33 corresponding to the engravings of the plates has been created, the lipophobic layer 32 is removed by appropriate means, for example as shown in FIG. 2B by a laser 34, or other equivalent means, to expose the lipophilic layer 31 between the structure 33. Therefore, as shown in an exaggerated way in FIG. 2B, the ink 35 is repelled by the lipophobic layer 32 and is accumulated in the exposed lipophilic structure of the layer 31 thus improving the preciseness of the inking of the engravings on the plate cylinder 6 by the blanket cylinder 8 and, by way of consequence, reducing the quantity of ink wiped away by the wiping cylinder 17 (see FIG. 1).

Figure 3B:
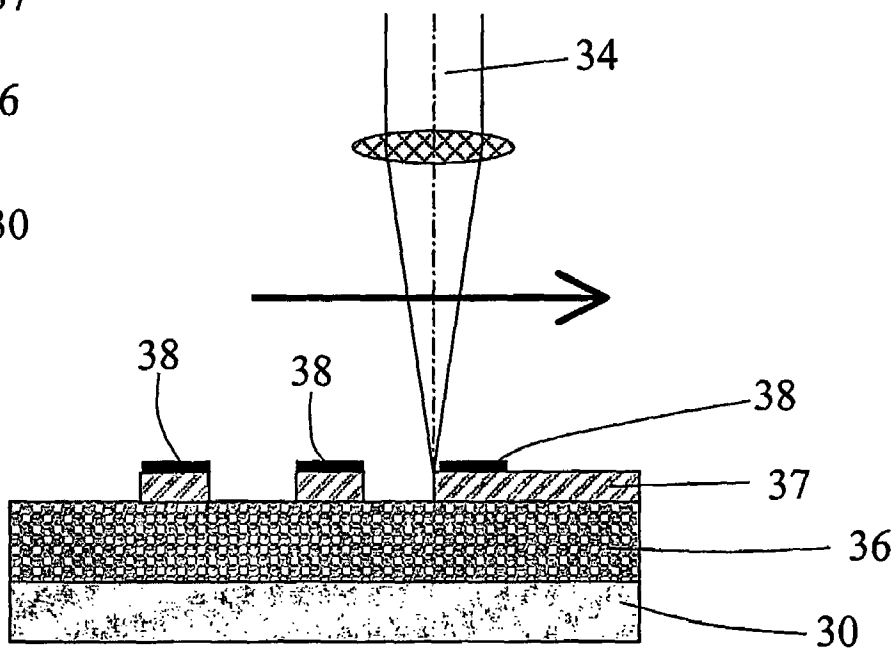
FIGS. 3A and 3B a schematic view of the layers forming the blankets of the blanket cylinder according to another embodiment; and in FIGS. 4A and 4B a schematic view of the layers forming the blankets of the blanket cylinder according to another embodiment.
Figure 3A:
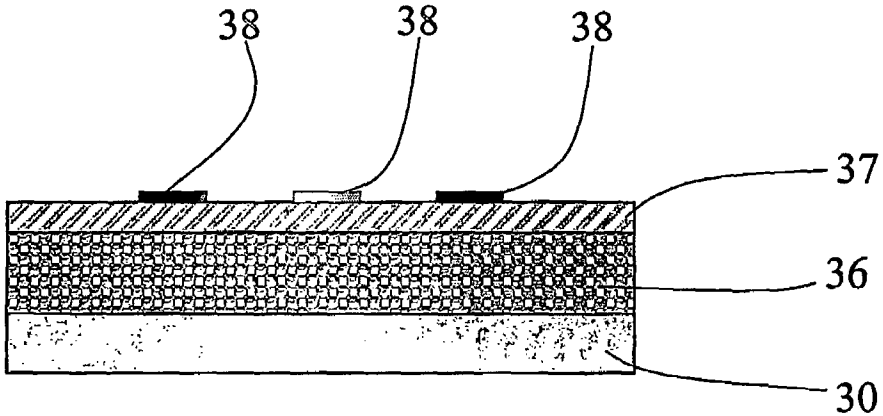

Another embodiment of the invention is further described with reference to FIGS. 3A and 3B. In this embodiment, the layers forming the surface of the blanket cylinder 8 are made of a base layer, of a lipophobic layer 36 and of a lipophilic engravable surface layer 37 on which a structure 38 which corresponds exactly to the shape of the engravings of the plates to be inked is created. The structure 38 may be created in the same way as structure 33 (see above). Through appropriate means, for example a laser 34, or other equivalent means, the lipophilic layer 37 is removed except under the structure 38, thus exposing the lipophobic layer 36 that repels the ink on the structure 38. This effect accordingly improves the preciseness of the inking of the intaglio plates.

Figure 4B:
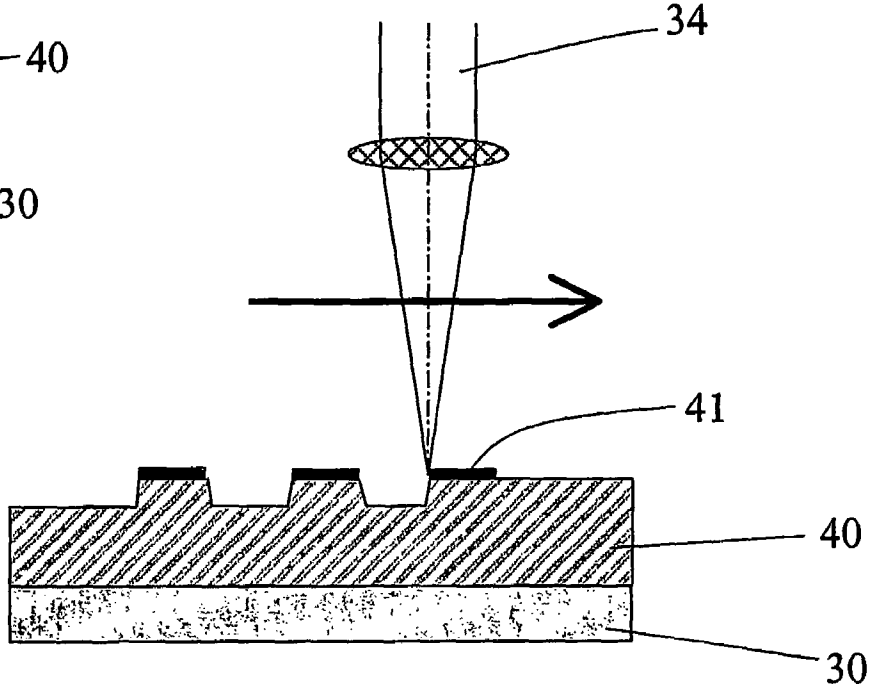
Figure 4A:
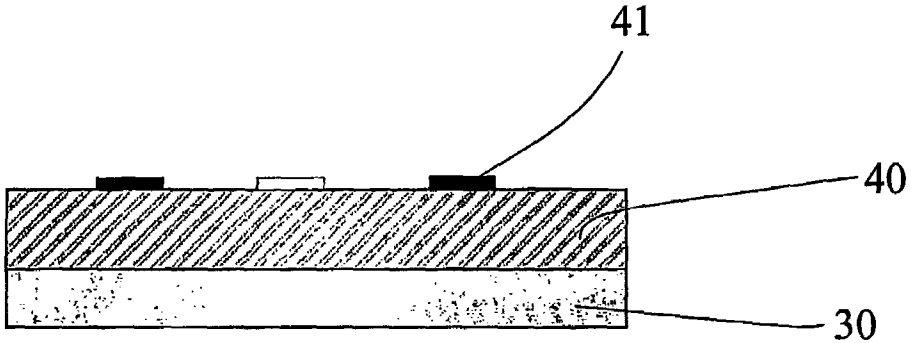

Another embodiment of the present invention is described with reference to FIGS. 4A and 4B. In these figures, the blanket cylinder 8 comprises a base layer 30 on which a lipophilic layer 40 is deposited, this lipophilic layer 40 further supporting a structure 41 corresponding to the shape of the engravings of the plates to be inked. Once the structure 41 has been created, for example in the same way as structures 33 or 38 (see above), in this embodiment, the lipophilic layer 40 is further engraved by appropriate means, for example a laser 34, or other suitable equivalent means, to remove a part of the layer 40 between the structure 41 as shown in FIG. 4B.

Preferably, the materials used as a lipophilic and hydrophobic material include but are not limited to rubber compositions, silicate compositions, and as lipophobic material include silicon compositions, rubber compositions. Of course, these materials are given by way of examples and other equivalent materials with appropriate characteristics are possible to carry out the present invention. Other examples are given by the sol-gel process, as known under the tradename ORMOCER®e, of the Fraunhofer Institut Silicatforschung (see for example the web pages published on the internet at the address www.isc.fhg.de) mentioned above.

Also preferably, the engraving operation of the blankets is made with the blanket cylinder 8 mounted in the printing machine in order to maintain a perfect register between the blanket cylinder 8 and the plate cylinder 6 once the structure 33, 38 or 41 has been created on the surface of the blanket cylinder 8.

The invention claimed is:

1. A blanket cylinder for an intaglio printing machine comprising at least a plate cylinder carrying printing plates with engravings corresponding to a specific intaglio structure to be printed on a substrate, and cooperating with an impression cylinder carrying a substrate to be printed, the blanket cylinder having at least one blanket on which the ink in the different colours is deposited by selector cylinders, each selector cylinder receiving ink of a given colour and having reliefs with contours corresponding to the area of the intaglio structure to be inked with said given colour, wherein said at least one blanket comprises an engraved lipophilic surface layer having non-engraved areas corresponding to the intaglio structure to be inked on said plate cylinder.

2. A blanket cylinder as defined in claim 1, wherein said engraved lipophilic surface layer is disposed over a lipophobic layer, said lipophobic layer being exposed in the areas where the lipophilic surface layer is engraved to repel ink to the non-engraved areas of said lipophilic surface layer.

3. An intaglio printing machine characterized by at least one blanket cylinder as defined in claim 2.

4. An intaglio printing machine characterized by at least one blanket cylinder as defined in claim 1.

5. A method for making a blanket cylinder according to claim 1, comprising the following steps:

mounting a non-engraved blanket on the blanket cylinder of the intaglio printing machine, said non-engraved blanket comprising at least an engravable lipophilic surface layer;

inking the blanket cylinder with its non-engraved blanket with the selector cylinders;

transferring the ink deposited on the blanket cylinder onto the plate cylinder;

wiping the surface of the plate cylinder to remove ink excess outside the engravings of the printing plate;

transferring again the ink from the plate cylinder to the blanket cylinder so as to form a structure on the blanket which corresponds exactly to the intaglio structure to be inked; and engraving the lipophilic surface layer in the areas where this lipophilic surface layer is not covered by the said structure.

6. The method of claim 5, wherein the lipophilic surface layer is engraved by means of a laser.

7. A blanket cylinder for an intaglio printing machine comprising at least a plate cylinder carrying printing plates with engravings corresponding to a specific intaglio structure to be printed on a substrate, and cooperating with an impression cylinder carrying a substrate to be printed, the blanket cylinder having at least one blanket on which the ink in the different colours is deposited by selector cylinders, each selector cylinder receiving ink of a given colour and having reliefs with contours corresponding to the area of the intaglio structure to be inked with said given colour, wherein said at least one blanket comprises an engraved lipophobic surface layer having engraved areas corresponding to the intaglio structure to be inked on said plate cylinder.

8. A blanket cylinder as defined in claim 7, wherein said engraved lipophobic surface layer is disposed over a lipophilic layer, said lipophilic layer being exposed in the areas where the lipophobic surface layer is engraved to accumulate ink between the non-engraved areas of said lipophobic surface layer.

9. An intaglio printing machine characterized by at least one blanket cylinder as defined in claim 7.

10. An intaglio printing machine characterized by at least one blanket cylinder as defined in claim 8.

11. A method for making a blanket cylinder according to claim 7, comprising the following steps:

mounting a non-engraved blanket on the blanket cylinder of the intaglio printing machine, said non-engraved blanket comprising at least an engravable lipophobic surface layer;

inking the blanket cylinder with its non-engraved blanket with the selector cylinders;

transferring the ink deposited on the blanket cylinder onto the plate cylinder;

wiping the surface of the plate cylinder to remove ink excess outside the engravings of the printing plate;

transferring again the ink from the plate cylinder to the blanket cylinder so as to form a structure on the blanket which corresponds exactly to the intaglio structure to be inked; and engraving the lipophobic surface layer in the areas where this lipophobic surface layer is covered by the said structure.

12. The method of claim 11, wherein the lipophobic surface layer is engraved by means of a laser.

* * * * *